US010288260B2

(12) United States Patent
Tsukatani et al.

(10) Patent No.: US 10,288,260 B2
(45) Date of Patent: May 14, 2019

(54) TURN SIGNAL FOR VEHICLE

(71) Applicant: Shin-Etsu Chemical Co., Ltd., Tokyo (JP)

(72) Inventors: Toshihiko Tsukatani, Echizen (JP); Toshihiro Tsumori, Echizen (JP); Kazuhiro Wataya, Echizen (JP); Masami Kaneyoshi, Echizen (JP); Takehisa Minowa, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 37 days.

(21) Appl. No.: 14/770,505

(22) PCT Filed: Feb. 28, 2014

(86) PCT No.: PCT/JP2014/055073
§ 371 (c)(1),
(2) Date: Aug. 26, 2015

(87) PCT Pub. No.: WO2014/136677
PCT Pub. Date: Sep. 12, 2014

(65) Prior Publication Data

US 2016/0010826 A1 Jan. 14, 2016

(30) Foreign Application Priority Data

Mar. 4, 2013 (JP) ..... 2013-041662
Sep. 26, 2013 (JP) ..... 2013-200007

(51) Int. Cl.
*F21S 43/251* (2018.01)
*F21S 43/27* (2018.01)
(Continued)

(52) U.S. Cl.
CPC ..... *F21V 9/30* (2018.02); *F21S 43/14* (2018.01); *F21S 43/255* (2018.01); *F21S 43/26* (2018.01);
(Continued)

(58) Field of Classification Search
CPC ..... F21S 48/2218; F21S 48/2212; F21S 48/2215; F21V 9/16
See application file for complete search history.

(56) References Cited

U.S. PATENT DOCUMENTS 4,305,116 A 12/1981 Huber
6,653,765 B1 11/2003 Levinson et al.
(Continued)

FOREIGN PATENT DOCUMENTS

JP 55-152635 A 11/1980
JP 2005-123165 A 5/2005
(Continued)

OTHER PUBLICATIONS

International Search Report dated Apr. 22, 2014, issued in counterpart International Application No. PCT/JP2014/055073 (2 pages).
(Continued)

*Primary Examiner* — Jong-Suk (James) Lee
*Assistant Examiner* — Eric T Eide
(74) *Attorney, Agent, or Firm* — Westerman, Hattori, Daniels & Adrian, LLP

(57) ABSTRACT

A turn signal for a vehicle has a blue LED as a light source, and an outer cover irradiated by the blue light. The outer cover includes a molded body of a polymeric material including phosphors dispersed therein that absorb blue light and emit light. By means of the present invention, it is possible to provide a turn signal for vehicles which has improved visibility and which imparts excellent visibility and sufficient luminous intensity over a wide angle. Further,
(Continued)

because the entire outer cover surface-emits light, uniformity of luminous intensity is ensured without subjecting the outer cover to light scattering treatment, enabling as a result preventing glare caused by light scattering treatment, making this turn signal safe without being unpleasant for pedestrians and drivers of nearby vehicles. Furthermore, because no complex optical design is necessary, this turn signal saves space and can be arranged in a vehicle.

10 Claims, 3 Drawing Sheets

(51) Int. Cl.

| | |
|---|---|
| ***F21V 9/30*** | (2018.01) |
| ***F21S 43/14*** | (2018.01) |
| ***F21S 43/20*** | (2018.01) |
| *F21Y 115/10* | (2016.01) |
| *F21W 103/20* | (2018.01) |

(52) U.S. Cl.
CPC ..... *F21W 2103/20* (2018.01); *F21Y 2115/10* (2016.08)

(56) References Cited

U.S. PATENT DOCUMENTS

| | | | | |
|---|---|---|---|---|
| 8,506,104 | B1 * | 8/2013 | Murphy | H01L 33/502 252/301.4 F |
| 8,845,156 | B2 | 9/2014 | Fukasawa et al. | |
| 9,287,469 | B2 * | 3/2016 | Chakraborty | H01L 33/501 |
| 9,595,644 | B2 * | 3/2017 | Li | H01L 33/502 |
| 2005/0117361 | A1 | 6/2005 | Takeda et al. | |
| 2006/0091790 | A1 * | 5/2006 | Nagatomi | C04B 35/581 313/503 |
| 2008/0013335 | A1 | 1/2008 | Tsutsumi | |
| 2008/0029720 | A1 | 2/2008 | Li | |
| 2009/0066230 | A1 * | 3/2009 | Hirosaki | C01B 21/0602 313/504 |
| 2009/0296211 | A1 * | 12/2009 | Schubert | G02B 3/08 359/457 |
| 2010/0172122 | A1 * | 7/2010 | Ramer | F21K 9/00 362/84 |
| 2010/0270567 | A1 * | 10/2010 | Emerson | F21K 9/00 257/89 |
| 2011/0194289 | A1 * | 8/2011 | Dong | F21V 5/04 362/296.1 |
| 2012/0267650 | A1 * | 10/2012 | Schubert | H01L 33/50 257/89 |
| 2013/0044457 | A1 | 2/2013 | Hikmet et al. | |
| 2013/0050979 | A1 * | 2/2013 | Van De Ven | F21V 3/04 362/84 |

FOREIGN PATENT DOCUMENTS

| | | | |
|---|---|---|---|
| JP | 2005-353814 | A | 12/2005 |
| JP | 2006-245080 | A | 9/2006 |
| JP | 2008-12759 | A | 1/2008 |
| JP | 2008-21578 | A | 1/2008 |
| JP | 2008-221965 | A | 9/2008 |
| JP | 5066462 | B2 | 11/2012 |
| WO | 2011/114253 | A1 | 9/2011 |

OTHER PUBLICATIONS

Extended (Supplementary) European Search Report dated Oct. 11, 2016, issued in counterpart European Patent Application No. 14759717.3. (7 pages).

* cited by examiner

TURN SIGNAL FOR VEHICLE

TECHNICAL FIELD

This invention relates to a vehicle-mount turn signal, and more particularly, to a turn signal which is mounted on or integral with an outer surface (front, side or rear surface) of a vehicle for advertising intent to change the driving direction of the vehicle to the outside (front, side or rear) of the vehicle.

BACKGROUND ART

Vehicles are fitted with turn signals or directional indicators for advertising the driving direction of the vehicle to the surrounding when the driver intends to change the driving direction. The turn signals used include a device comprising an incandescent bulb or halide bulb combined with an orange-colored light-transmitting resin to produce orange light, a device comprising an incandescent bulb or halide bulb whose surface is coated orange to produce orange light, permitting use of a clear cover lens, and a device using an orange LED instead of the conventional bulb as a light source to produce orange light while taking the advantages of LED including low power consumption and compact size. Particularly in the case of turn signals using point light sources, to meet the safety standards of turn signals, the turn signals are typically constructed such that the outer lens is provided with a rugged configuration for scattering light and expanding the luminous area.

Among vehicle-mount turn signals, there has been implemented a system comprising turn signals mounted to door mirrors on vehicle doors and turn signals mounted at the front and rear of the vehicle, wherein the turn signals are concurrently lit to advertise intent to change the driving direction to the surrounding.

CITATION LIST

Patent Documents

Patent Document 1: JP-A 2008-221965

SUMMARY OF INVENTION

Technical Problem

Because of a point light source, the prior art vehicle-mount turn signals using incandescent bulbs, halide bulbs and orange LEDs have the problem that even when the outer lens is treated for light scattering, the luminance of light is high at the center, but low on the outer periphery of the outer lens. Another problem is that visibility is very low at a certain angle to the turn signal and its blink is awkward to view.

When the outer lens is treated for light scattering in order to spread light from a point light source over a wide area, light from the outer lens gives glare to the person in a certain view direction, which is discomfort to drivers and pedestrians. Such glare causes a sudden drop of the capacity to judge a situation, which is dangerous. In the case of a turn signal using orange LEDs to produce a line of light when lit, since light emission over a certain area along the line is necessary, a multiplicity of orange LEDs must be arranged to provide for a sufficient emissive area, which is uneconomical.

An object of the invention, which has been made under the above circumstances, is to provide a vehicle-mount turn signal which produces a necessary sufficient luminous intensity and good visibility not only in the optical axis of illumination, but also at angles off the optical axis, and has the controlled incidence of glare.

Solution to Problem

Making extensive investigations to solve the outstanding problems, the inventors have found that if a blue LED array capable of emitting blue light as a light source and an outer cover adapted to receive blue light are provided, a base housing on which the blue LED array is mounted is optionally provided, a molded body obtained by dispersing a phosphor capable of absorbing blue light and emitting light in a polymer material and molding the material is used as the outer cover, and these components are constructed such that blue light emitted by the blue LED array enters the outer cover, then the phosphor in the molded body is excited by blue light and emits light of converted wavelength whereby light exits the outer cover over its entirety. There is obtained a vehicle-mount turn signal capable of illuminating isotropic light. Differently stated, there is obtained a vehicle-mount turn signal having a very wide angle of luminous intensity distribution. The vehicle-mount turn signal produces a necessary sufficient luminous intensity and good visibility not only in the optical axis of illumination, but also at angles off the optical axis, and has the controlled incidence of glare. The invention is predicated on this finding.

Accordingly, the invention provides a vehicle-mount turn signal as defined below.

[1] A vehicle-mount turn signal comprising a blue LED array capable of emitting blue light as a light source and an outer cover adapted to receive blue light, said outer cover comprising a molded body of a polymer material having dispersed therein a phosphor capable of absorbing blue light and emitting light.

[2] The vehicle-mount turn signal of [1], further comprising a base housing on which the blue LED array is mounted.

[3] The vehicle-mount turn signal of [1] or [2] wherein the phosphor is an orange emissive phosphor.

[4] The vehicle-mount turn signal of [3] wherein the orange emissive phosphor is an orange emissive phosphor of garnet structure.

[5] The vehicle-mount turn signal of any one of [1] to [4] wherein the polymer material is at least one resin selected from thermoplastic resins and thermosetting resins.

[6] The vehicle-mount turn signal of [5] wherein the thermoplastic resin is at least one resin selected from the group consisting of a polyethylene, polypropylene, polystyrene, polycarbonate, ABS resin and acrylic resin.

[7] The vehicle-mount turn signal of [5] or [6] wherein the thermosetting resin is at least one resin selected from the group consisting of a silicone resin, epoxy resin, phenolic resin, urethane resin and unsaturated polyester resin.

[8] The vehicle-mount turn signal of any one of [1] to [7] wherein said blue LED array comprises a chip serving as an emissive part encapsulated with an encapsulant having a light scattering agent dispersed therein.

[9] The vehicle-mount turn signal of any one of [1] to [7], further comprising a light scattering member disposed forward of the blue LED array in the emission direction, the light scattering member having a light scattering agent dispersed therein.

[10] The vehicle-mount turn signal of any one of [1] to [7], further comprising a lens disposed forward of the blue LED array in the emission direction for imparting a luminous intensity distribution angle to the blue light from the blue LED array.

[11] The vehicle-mount turn signal of any one of [1] to [10] wherein the outer cover has a textured surface of rugged configuration.

[12] The vehicle-mount turn signal of any one of [1] to [10], further comprising a color filter disposed outside the outer cover.

[13] The vehicle-mount turn signal of [12] wherein the color filter has a textured surface of rugged configuration.

[14] The vehicle-mount turn signal of any one of [1] to [13] which is integrated with an outer surface portion of the vehicle so that light is illuminated outside the vehicle.

Advantageous Effects of Invention

The invention provides a vehicle-mount turn signal having improved visibility, a sufficient luminous intensity over a wide angle, and satisfactory visibility. Since the outer cover emits light over its entirety, that is, produces surface light emission, the turn signal ensures the uniformity of luminous intensity without a treatment of the outer cover for light scattering, thereby controlling the incidence of glare caused by the light scattering treatment and avoiding any discomfort to drivers of nearby vehicles and pedestrians, with the benefit of safety. Since no complex optical design is necessary, the turn signal can be mounted in a limited space of the vehicle.

DESCRIPTION OF EMBODIMENTS

Figure 1:
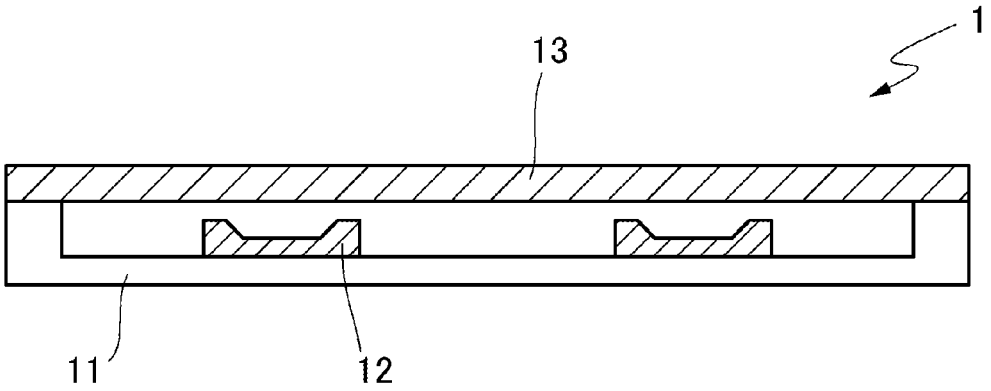
FIG. 1 is a cross-sectional view of a vehicle-mount turn signal in a first embodiment of the invention.

Now the invention is described in detail.

The vehicle-mount turn signal of the invention comprises a blue LED array capable of emitting blue light as a light source and an outer cover adapted to receive blue light. The turn signal may further comprise a base housing. The blue LED array is generally mounted on the base housing although it may be attached to the outer cover using a support frame or the like.

The blue LED array used as the light source is typically a LED array capable of emitting light having a center wavelength in the range of 420 nm to 490 nm. The size, power and number of blue LED arrays may be appropriately selected by taking into account the light quantity, visibility, alerting function, decoration and other factors of the vehicle-mount turn signal. A blue LED array having one chip (emissive part) or a blue LED array having a plurality of chips (emissive parts) may be used alone or in combination of two or more. Such blue LED arrays are commercially available. The blue LED array used herein may be a blue LED array comprising a chip serving as an emissive part, encapsulated with an encapsulant such as resin having a light scattering agent dispersed therein, or a light scattering member of a resin or similar material having a light scattering agent dispersed therein may be disposed forward of the blue LED array in the emission direction. Since these means cause blue light as excitation light to be scattered, more uniform light emission emanates from the outer cover. Alternatively, a lens may be disposed forward of the blue LED array in the emission direction for imparting a luminous intensity distribution angle to the blue light from the blue LED array.

In the vehicle-mount turn signal of the invention, the outer cover is disposed at a position apt to receive blue light, especially forward of the blue LED array in the emission direction. The outer cover comprises a molded body of a polymer material having dispersed therein a phosphor capable of absorbing blue light and emitting light. In the vehicle-mount turn signal, the blue LED array emits blue light which is absorbed by the phosphor in the outer cover where it is wavelength converted, and the phosphor emits light of converted wavelength. When an orange emissive phosphor is used as the phosphor, the blue light is converted into orange light, specifically orange light having the maximum intensity in the wavelength range of 550 nm to 610 nm.

The polymer material (organic polymer material) of which the outer cover is made may be selected from thermoplastic resins and thermosetting resins because of easy control of dispersion of phosphor particles therein. Of these, thermoplastic resins are preferred for easy post-working into the desired shape. Further, the outer cover made of thermoplastic resin is not only resistant to crack by vibration and shocks, that is, vibration resistant and shock resistant, but also weather resistant, indicating that the cover is best suited as a vehicle-mount member.

Preferred examples of the thermoplastic resin include polyethylene, polypropylene, polystyrene, polycarbonate, ABS resins, and acrylic resins. Preferred examples of the thermosetting resin include silicone resins, epoxy resins, phenolic resins, urethane resins, and unsaturated polyester resins. On use of thermosetting resins, it is sometimes prohibited from the aspects of strength and weather resistance to use a thermosetting resin as the outermost layer, and in such a case, a molded body of a thermosetting resin having a phosphor dispersed therein may be formed inside the outermost layer made of a thermoplastic resin. It is preferred from the aspect of utilizing the light emission resulting from wavelength conversion, typically orange light to the maximum extent that the resin be used in transparent or white color state without coloring, although a colored resin may be used in combination for adjusting the color of light emission. The colored resin may be used as the resin in which the phosphor is dispersed, or used in combination with the layer of polymer material having the phosphor dispersed therein, as an inner or outer layer.

In the vehicle-mount turn signal, the light-emissive component (phosphor) mixed in the polymer material of which the outer cover is made is a phosphor capable of absorbing blue light, specifically blue light having a wavelength of 420 nm to 490 nm and emitting light via wavelength conversion, preferably an orange emissive phosphor capable of emitting orange light, specifically orange light having the maximum intensity in a wavelength range of 550 nm to 610 nm. Preferred examples of the orange emissive phosphor include $(Sr, Ca, Ba)_2SiO_4$:Eu, Ca-α-SiAlON:Eu, $CaGa_2S_4$:Eu, $(Y,Gd)_3Al_5O_{12}$:Ce, and $Y_3Al_5O_{12}$:Ce phosphors. Inter alia, Ca-α-SiAlON:Eu phosphor having α-SiAlON structure and $(Y,Gd)_3Al_5O_{12}$:Ce and $Y_3Al_5O_{12}$:Ce phosphors having garnet structure (garnet phase) are preferred for luminous intensity and durability, but the phosphors are not limited thereto. When it is desired to extract light over a wider angle, a phosphor having a higher refractive index may be dispersed in the polymer material. This enables to extract light over a wider angle.

The phosphor used herein may be prepared by any well-known methods. Also commercial products may be used. The phosphor should preferably be in particulate form having a particle size of at least 1 μm, more preferably at least 8 μm, as expressed by a diameter D50 at 50% by volume cumulative in the particle size distribution. Additionally, the particulate phosphor preferably has a diameter D90 of up to 30 μm, more preferably up to 25 μm, D90 being a diameter at 90% by volume cumulative in the particle size distribution. If D50 is less than the range, a proportion of scattering may be excessively greater than a proportion of absorption/conversion with respect to the excitation light from blue LED array. Although the maximum of D50 need not be definitely limited, a D50 value of up to 20 μm is preferred from its relationship to the D90 value. Also, if D90 exceeds the range, inconvenience like short dispersion may occur when the phosphor is mixed with the polymer material.

It is noted that the particle size is preferably measured, for example, by dispersing sample particles in a gas or water stream and measuring the diameter by the laser diffraction scattering method because the particle size distribution can be evaluated at the same time.

The outer cover used herein is a molded body obtained by mixing a polymer material with a phosphor or emissive substance and molding the polymer material. By any of well-known molding techniques such as compression molding, extrusion molding and injection molding, the polymer material may be molded to any desired shape such as film or thin plate and to any desired size, depending on the intended application, shape, and light (orange light) projection mode of the vehicle-mount turn signal. Also preferably the outer cover is molded to a shape corresponding to the shape of an outer surface portion of the vehicle. The outer cover may have a thickness clearing the safety standards. If necessary, the outer cover may be textured on a surface portion whereby the outer cover surface is provided with a texture of rugged configuration, yielding uniform distribution of light over a wider angle.

The polymer material and the phosphor are mixed in a ratio which varies, depending on the shape, size, and thickness of the outer cover, relationship of blue LED to the outer cover, and the like. Preferably the phosphor is used in an amount of 1 to 30% by weight, more preferably 1 to 20% by weight based on the polymer material. If the amount of the phosphor is below the range, the absorption of blue light emitted by blue LED may be low, resulting in shortage of light emission, though depending on the size of the outer cover. If the amount of the phosphor is beyond the range, the outer cover may have low strength because the phosphor is excessive relative to the polymer material.

Besides the phosphor as the emissive component, a powdered inorganic compound that does not absorb orange light, such as silica, alumina or titania may be added to and dispersed in the polymer material in order that the outer cover produce more uniform emission in its entirety. Also, for the purpose of enhancing weather resistance, the outer cover may be covered on its surface with another transparent material having higher weather resistance than the polymer material used.

In the vehicle-mount turn signal, a color filter may be disposed outside the outer cover. For the purpose of improving the color purity of light of converted wavelength at the emissive surface, the turn signal may be covered outside the outer cover with a light-transmitting cover capable of reflecting or absorbing light other than the color of illuminating light, typically blue light. This inhibits the possibility that the color of illuminating light changes if a portion of blue light as excitation light leaks out of the outer cover without being absorbed therein. If necessary, the color filter may be textured on a surface portion whereby the color filter surface is provided with a texture of rugged configuration, yielding a uniform distribution of light over a wider angle.

The vehicle-mount turn signal may be integrated with an outer surface portion of the vehicle so that light is illuminated outside the vehicle. Since the turn signal does not require any complex optical design, it can be mounted in a limited space of the vehicle and advantageously integrated with the outer surface portion of the vehicle.

Referring to the figures, the structure of the vehicle-mount turn signal according to the invention is described.

FIG. 1 is a cross-sectional view of a vehicle-mount turn signal in a first embodiment of the invention. The vehicle-mount turn signal 1 includes a base housing 11 of rectangular box shape with open top, and two surface-mounted blue LED packages 12 disposed on the inner surface of the base housing 11 at the back side of the turn signal 1 (opposite to the illuminating direction of wavelength converted light) for emitting blue light forward of the turn signal 1 (in the illuminating direction of wavelength converted light). Notably, the number of blue LED packages is not particularly limited, and this is true to all the following embodiments. The turn signal 1 further includes an outer cover 13 of plate shape disposed forward of the turn signal 1 and opposed to the blue LED packages 12 in the emission direction of blue light.

The blue LED package 12 emits blue light which enters outer cover 13 directly or after reflection by the inner surface of the turn signal (base housing 11). Blue light incident on outer cover 13 is absorbed by the phosphor in outer cover 13 and converted thereby to light, typically orange light. Light of converted wavelength or orange light exiting outer cover 13 travels forward of turn signal 1 directly or after reflection by the inner surface of the turn signal.

Figure 2:
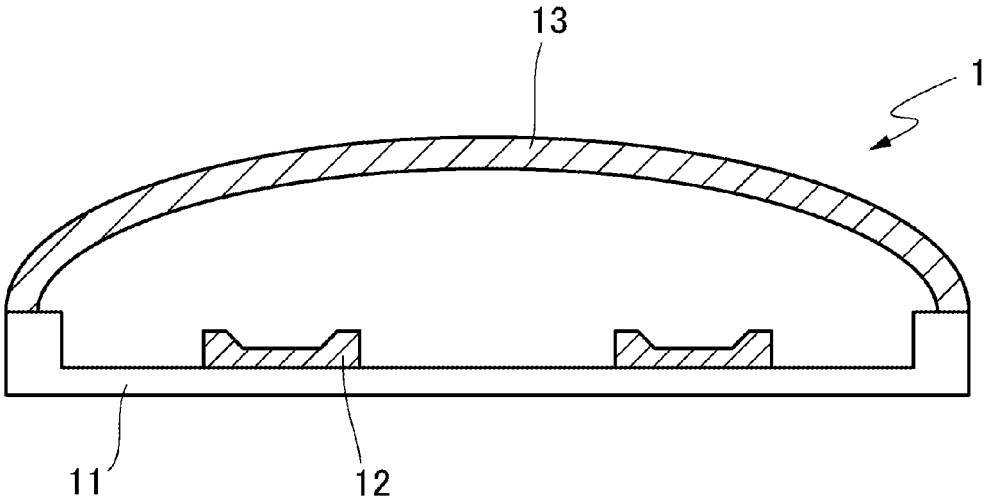
FIG. 2 is a cross-sectional view of a vehicle-mount turn signal in a second embodiment of the invention.

FIG. 2 is a cross-sectional view of a vehicle-mount turn signal in a second embodiment of the invention. This vehicle-mount turn signal 1 is different from the turn signal in the first embodiment of FIG. 1 in that the outer cover 13 of plate shape is replaced by an outer cover 13 of convex shape having an arch cross section. The components other than the outer cover are designated by the same reference numerals as in FIG. 1, and their description is omitted. On use of the convex shape outer cover having an arch cross section, sufficient visibility is available in a direction of 90° with respect to the optical axis of illumination of the turn signal, and even in a direction of more than 90°.

Figure 3:
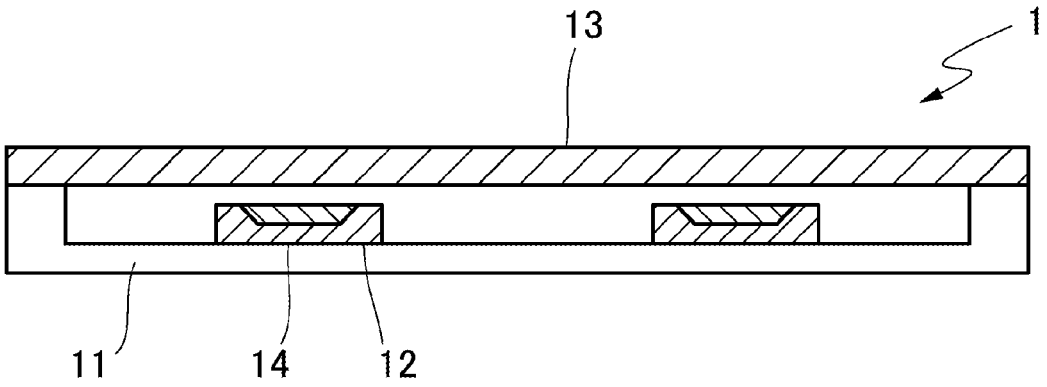
FIG. 3 is a cross-sectional view of a vehicle-mount turn signal in a third embodiment of the invention.

FIG. 3 is a cross-sectional view of a vehicle-mount turn signal in a third embodiment of the invention. This vehicle-mount turn signal 1 is different from the turn signal in the first embodiment of FIG. 1 in that a light scattering member (encapsulant having a light scattering agent dispersed therein) 14 is disposed forward of the blue LED package 12 in the emission direction of blue light from the blue LED package 12. The components other than the light scattering member (encapsulant) 14 are designated by the same reference numerals as in FIG. 1, and their description is omitted. On use of the light scattering member (encapsulant), light of converted wavelength or orange light is illuminated more uniformly.

Figure 4:
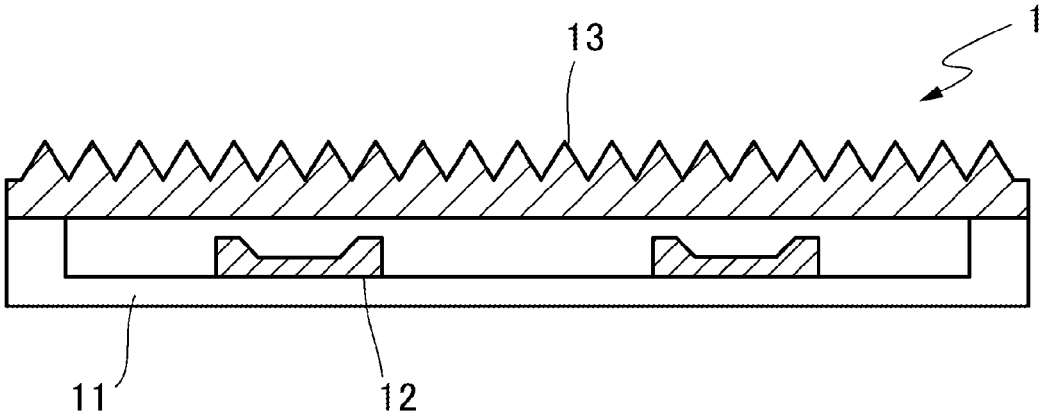
FIG. 4 is a cross-sectional view of a vehicle-mount turn signal in a fourth embodiment of the invention.

FIG. 4 is a cross-sectional view of a vehicle-mount turn signal in a fourth embodiment of the invention. This vehicle-mount turn signal 1 is different from the turn signal in the first embodiment of FIG. 1 in that the outer cover 13 of plate shape is replaced by an outer cover 13 having a texture of rugged structure on the outside. The components other than the outer cover are designated by the same reference numerals as in FIG. 1, and their description is omitted. Although the turn signal produces surface emission so that uniform illumination having a wide angle of luminous intensity distribution is available even from the outer cover of plate shape, the effect of uniform illumination is further enhanced by the provision of the outer cover with a texture on its surface.

Figure 5:
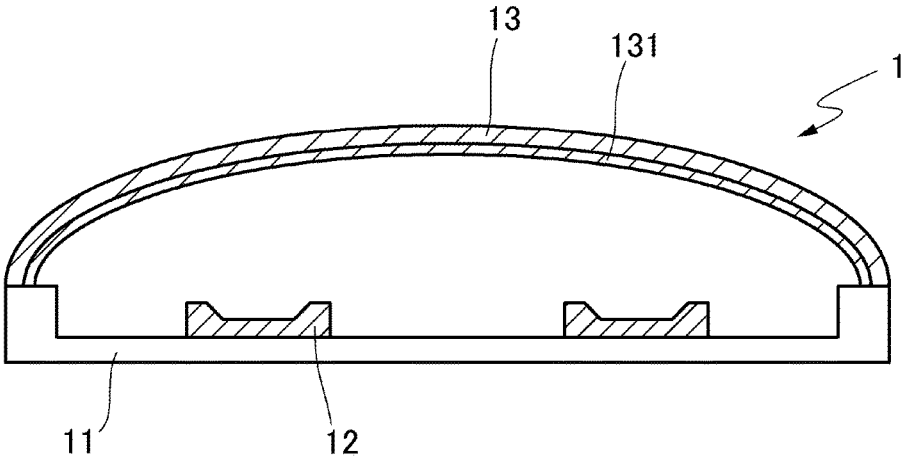
FIG. 5 is a cross-sectional view of a vehicle-mount turn signal in a fifth embodiment of the invention.

FIG. 5 is a cross-sectional view of a vehicle-mount turn signal in a fifth embodiment of the invention. This vehicle-mount turn signal 1 is different from the turn signal in the second embodiment of FIG. 2 in that the outer cover 13 is composed of two layers including an inner layer 131 formed of a silicone resin having a phosphor dispersed therein. The inner layer may be formed by any suitable means, for example, by coating the inner surface of the outer layer with a liquid silicone composition having a phosphor dispersed therein and curing, or by attaching a silicone resin sheet having a phosphor dispersed therein to the inner surface of the outer layer. The components other than the outer cover are designated by the same reference numerals as in FIG. 2, and their description is omitted.

The intensity of light projected forward of the vehicle-mount turn signal may be properly selected depending on the number of chips (emissive parts), the number of blue LED arrays, electric current value, and the like.

For efficient utilization of light emitted by the blue LED array, a reflecting mirror or plate may be disposed on the back and/or lateral side of the turn signal with respect to the blue LED array. Also for efficiency, the reflecting mirror or plate may be disposed such that the light exiting the outer cover may travel in the projection direction of the turn signal.

The structure of the vehicle-mount turn signal is not limited to the above-illustrated embodiments as long as the turn signal includes a blue LED array and an outer cover such that light exiting the turn signal may be efficiently projected forward of the turn signal.

Since the outer cover used in the vehicle-mount turn signal is constructed such that the phosphor may emit light upon absorption of blue light, light is illuminated in all directions, i.e., the illumination is non-directional. Therefore, as long as an outer cover molded to a proper shape is used in a turn signal, the resulting vehicle-mount turn signal produces light having high visibility in any directions, i.e., uniform visibility when lit. Since the outer cover utilizes the wavelength conversion of blue light at a high efficiency, a saving of power consumption over the prior art is another advantage.

As the vehicle-mount turn signal, turn signals of diverse types using a linear light source, surface light source or 3D light source can be designed, without being bound to the design using a point light source as in the prior art. A higher freedom of design than in the prior art is allowed for the vehicle-mount turn signal, leaving a room for adopting new and innovative designs.

EXAMPLES

Examples and Comparative Examples are given below by way of illustration and not by way of limitation.

Example 1

A vehicle-mount turn signal as shown in FIG. 1 was manufactured. An outer cover was prepared by mixing polycarbonate resin with 20% by weight of YAG:Ce phosphor (particle size:volume cumulative diameter D50=15 μm and D90=21 μm) as the orange emissive phosphor, and molding the mixture. The outer cover was disposed above and opposed to a base housing on which blue LED packages having an emission peak at 460 nm were mounted. Provided that the angle of a perpendicular direction to the emission surface of the outer cover (the optical axis of illumination of the turn signal) is 0°, the light produced by the turn signal was measured for luminous intensity in the perpendicular direction and luminous intensity at angles oblique to the perpendicular direction. The result is shown in Table 1 as a relative intensity to the luminous intensity in the perpendicular direction. This turn signal displayed the improved uniformity of luminous intensity over a wide angle ranging from 0° to 70°. It is thus expected that the turn signal has the controlled incidence of glare.

Comparative Example 1

A commercially available automotive turn signal was analyzed as in Example 1. Provided that the angle of a perpendicular direction to the emission surface of the outer lens is 0°, the light produced by the turn signal was measured for luminous intensity in the perpendicular direction and luminous intensity at angles oblique to the perpendicular direction. The result is shown in Table 1 as a relative intensity to the luminous intensity in the perpendicular direction. This turn signal uses an incandescent bulb as the light source and an orange-colored light-transmitting resin member treated for light scattering as the outer lens. In this turn signal, the scatter-treated outer lens is combined with a point light source to utilize the scatter-treated surface for expanding the angle of view. A sharp drop of luminous intensity was observed at positions off the perpendicular direction to the emission surface of the outer lens (the optical axis of illumination of the turn signal). Since a luminous intensity high enough to clear the safety standards must be available even at those angles where a lower luminous intensity is originally available, the turn signal produces light of a higher luminous intensity than the necessity at those angles where a high luminous intensity is originally available. Therefore, the turn signal has concerns for the incidence of glare.

While the illumination of the turn signal of Comparative Example 1 was barely visible in a direction of 70° and at a distance of 100 m in daytime, the visibility of the turn signal of Example 1 was examined under the same conditions. The turn signal of Example 1 was readily viewed because orange light emanated over the entire surface of the outer cover.

TABLE 1

| | Angle (°) | | | | | | | |
|---|---|---|---|---|---|---|---|---|
| | 0 | 10 | 20 | 30 | 40 | 50 | 60 | 70 |
| Example 1 | 1 | 0.984 | 0.985 | 0.992 | 0.999 | 0.994 | 0.965 | 0.879 |
| Comparative Example 1 | 1 | 0.088 | 0.691 | 0.009 | 0.006 | 0.005 | 0.002 | 0.001 |

REFERENCE SIGNS LIST

1 vehicle-mount turn signal
11 base housing

12 blue LED package
13 outer cover
131 inner layer
14 light scattering member (encapsulant)

The invention claimed is:

1. A vehicle-mount turn signal projecting orange light and comprising:

a blue LED array capable of emitting blue light as a light source and an outermost cover adapted to receive blue light, said outermost cover comprising a molded body of a polymer material having dispersed therein an orange emissive phosphor of garnet structure capable of absorbing blue light and emitting orange light, wherein the orange emissive phosphor is in particulate form having a particle size of 1 to 20 μm, as expressed by a diameter D50 at 50% by volume cumulative in the particle size distribution, the orange emissive phosphor of garnet structure is selected from the group consisting of $(Y,Gd)_3Al_5O_{12}$:Ce phosphor and $Y_3Al_5O_{12}$:Ce phosphor, and the phosphor is dispersed in the outermost cover in an amount of 1 to 20% by weight, based on the polymer material.

2. The vehicle-mount turn signal of claim 1, further comprising a base housing on which the blue LED array is mounted.

3. The vehicle-mount turn signal of claim 1 wherein the polymer material is at least one resin selected from thermoplastic resins and thermosetting resins.

4. The vehicle-mount turn signal of claim 3 wherein the thermoplastic resin is at least one resin selected from the group consisting of a polyethylene, polypropylene, polystyrene, polycarbonate, ABS resin and acrylic resin.

5. The vehicle-mount turn signal of claim 3 wherein the thermosetting resin is at least one resin selected from the group consisting of a silicone resin, epoxy resin, phenolic resin, urethane resin and unsaturated polyester resin.

6. The vehicle-mount turn signal of claim 1 wherein said blue LED array comprises a chip serving as an emissive part encapsulated with an encapsulant having a light scattering agent dispersed therein.

7. The vehicle-mount turn signal of claim 1, further comprising a light scattering member disposed forward of the blue LED array in the emission direction, the light scattering member having a light scattering agent dispersed therein.

8. The vehicle-mount turn signal of claim 1, further comprising a lens disposed forward of the blue LED array in the emission direction for imparting a luminous intensity distribution angle to the blue light from the blue LED array.

9. The vehicle-mount turn signal of claim 1, wherein the outermost cover has a textured surface of rugged configuration.

10. The vehicle-mount turn signal of claim 1 which is integrated with an outer surface portion of the vehicle so that light is illuminated outside the vehicle.

* * * * *